US009932053B2

(12) United States Patent
Bi et al.

(10) Patent No.: US 9,932,053 B2
(45) Date of Patent: Apr. 3, 2018

(54) HAND BRAKE LIMITING DEVICE

(71) Applicant: CRRC QINGDAO SIFANG ROLLING STOCK RESEARCH INSTITUTE CO., LTD., Qingdao, Shandong (CN)

(72) Inventors: Jingquan Bi, Shandong (CN); Chaoheng Wang, Shandong (CN); Xiangrui Li, Shandong (CN); Jigang Zhou, Shandong (CN); Xin Zhang, Shandong (CN); Chao Lin, Shandong (CN)

(73) Assignee: CRRC QINGDAO SIFANG ROLLING STOCK RESEARCH INSTITUTE CO., LTD., Shandong (CN)

( * ) Notice: Subject to any disclaimer, the term of this patent is extended or adjusted under 35 U.S.C. 154(b) by 23 days.

(21) Appl. No.: 15/231,702

(22) Filed: Aug. 8, 2016

(65) Prior Publication Data

US 2016/0347335 A1 Dec. 1, 2016

Related U.S. Application Data

(63) Continuation of application No. PCT/CN2014/088389, filed on Oct. 11, 2014.

(30) Foreign Application Priority Data

May 19, 2014 (CN) ..... 2014 1 0211955

(51) Int. Cl.
*B61H 15/00* (2006.01)
*B61H 13/04* (2006.01)
(Continued)

(52) U.S. Cl.
CPC ..... *B61H 13/04* (2013.01); *B61H 13/20* (2013.01)

(58) Field of Classification Search
CPC ..... B61H 13/02; B61H 13/04; B61H 13/20
See application file for complete search history.

(56) References Cited

U.S. PATENT DOCUMENTS 2,905,292 A 9/1959 Bretz, Jr. et al. ..... 192/16
3,173,305 A * 3/1965 Mersereau ..... B61H 13/04 74/505

(Continued)

FOREIGN PATENT DOCUMENTS

CA 2 633 968 11/2008
CN 1356230 A 7/2002

(Continued)

OTHER PUBLICATIONS

International Search Report of corresponding International PCT Application No. PCT/CN2014/088389, dated Oct. 11, 2014.

*Primary Examiner* — Melody M Burch
(74) *Attorney, Agent, or Firm* — J.C. Patents

(57) ABSTRACT

Provided is a hand brake limiting device, comprising a bearing I (10), a spring, a spring holder (12), a guide plate (9), and a guide plate holder (23); the bearing I (10) is disposed on the spring holder (12); the spring is sleeved on the outside of the bearing I (10); the guide plate (9) and the guide plate holder (23) are sequentially disposed at one side of the spring away from the spring holder (12); a stopper post III (7) is secured to one side of the spring holder (12) facing the spring; a stopper post In (8) is secured to one side of the guide plate (9) facing the spring; a stopper post II (26) is secured to one side of the guide plate holder (23) facing the guide plate (9).

10 Claims, 10 Drawing Sheets

(51) Int. Cl.
*B61H 13/20* (2006.01)
*B60T 13/04* (2006.01)

(56) References Cited

U.S. PATENT DOCUMENTS

| | | | | |
|---|---|---|---|---|
| 3,176,539 | A * | 4/1965 | Mersereau | B61H 13/04 188/33 |
| 3,620,098 | A | 11/1971 | Natschke | 74/505 |
| 3,803,940 | A | 4/1974 | La Belle | 74/505 |
| 6,179,093 | B1 | 1/2001 | Daugherty, Jr. | 188/33 |
| 2010/0193755 | A1* | 8/2010 | Klasing | B61H 13/04 254/345 |

FOREIGN PATENT DOCUMENTS

| | | | |
|---|---|---|---|
| CN | 101746394 | A | 6/2010 |
| CN | 103342130 | | 10/2013 |

* cited by examiner

HAND BRAKE LIMITING DEVICE

CROSS-REFERENCE TO RELATED APPLICATIONS

This application is a continuation of International application No. PCT/CN2014/088389 filed on Oct. 11, 2014, entitled Hand Brake Limiting Device, which claims the priority benefit of Chinese patent application No. 201410211955.1, filed on May 19, 2014. The contents of the above-mentioned patent applications are incorporated by reference herein in their entirety and made a part of this specification.

FIELD OF THE INVENTION

This invention belongs to a mechanical field, related to a limiting device, and in particular, to a hand brake limiting device.

BACKGROUND OF THE INVENTION

A hand brake is a mechanism installed on the vehicle braking device by means of man power as the motive power, and it is mainly used in railway wagons. When the railway wagon is commissioning or is parking, by manually operate the hand brake with man power as the motive power, to produce the braking force, and the braking force is transmitted to the brake shoe through basic braking device, then the brake shoe is close to the wheel to produce braking. The common hand brake usually comprises of a hand wheel, a chain, an enclosure, a drive shaft assembly disposed in the enclosure, bull gear and base; hand wheel and drive shaft assembly are connected, one end of the chain is fixed on the bull gear, and the other end is connected with the fixed pulley arranged at the bottom of the braked vehicle through a hand brake pull rod. The prior art 201310296003.X discloses a "hand brake, braking device and railway wagons". As stated in the background of the prior are, when braking, a hand wheel drives a pinion to rotate clockwise by a drive shaft, and then drives the bull gear to rotate counterclockwise, and the ratchet and pawl rotate oppositely. When the bull gear rotates, the chain is wrapped around the bull gear spindle, thereby applying a braking force to the pull rod of the basic braking device. When the hand brake is working, the opinion is connected with the drive shaft through a clutch, at this time, rotate the hand wheel, and the drive shaft will rotate; when an operator releases the hand wheel, the ratchet has a tendency of reverse rotation due to the gravity of the chain, however, with blocking effect of the pawl, the ratchet will not rotate, nor drive the chain to move, so as to maintain the braking effect. When it is necessary to relieve, operate the clutch, to separate the pinion from the drive shaft. At this time, the chain moves under the gravity, and drive the pinion to rotate relative to the drive shaft by the bull gear, to achieve remission operation. However, this kind of hand brake has the following drawbacks: (1) when a convertible is coupled with a truck, usually there is interference of the hand brake hand wheel and the windshield; (2) The chain-hand brake pull rod and the wheel groove of the fixed pulley are not in a straight line, the design is unreasonable, which will not only affect the appearance, but also the transmission efficiency is low, easily leading to the wear of the fixed pulley and hand brake lever.

In order to solve the interferences of hand wheel of hand brake and the bus windshield, the prior hand brake needs to offset 125 mm or more to the outside of the vehicle horizontally, which will lead to form a lateral shift of about 100 mm between the chain center at the chain winding shaft end and the chain center at the fixed pulley end. Therefore, when 100 mm offset easily causes braking by the hand brake, the chain and enclosure are clamped, and the chain and movable pulley interfere, affecting the performance of the hand brake. Besides, the excessive offset may cause decreased transmission efficiency of fixed pulley, and the poor visual effect worsens. Through the structural analysis of the convertibles and hand brake, it is unable to guarantee the performance of the hand braking system of the truck only by adjusting the installation position of the hand brake on the vehicle to resolve the interference of the hand wheel of hand brake and the passenger windshield, and it is necessary to improve the structure of the NSW type hand brake.

SUMMARY OF THE INVENTION

In order to resolve the above problems of the hand brake, the present application provides a hand brake with limiting device.

The application adopts the following technical solutions: A hand brake comprises a hand wheel, a chain, an enclosure, a drive shaft assembly disposed in the enclosure, a bull gear and a base assembly. The hand wheel is connected with the drive shaft assembly, and one end of the chain is fixed to the bull gear through the rivet, and the main shaft of the bull gear is chain winding shaft. The other end of the chain is connected with the fixed pulley arranged at the bottom of the braking vehicle through a hand brake pull rod. The drive shaft assembly comprises a drive shaft, a pin wheel, a clutch, a ratchet, a pinion and an end part arranged sequentially. The hand wheel is disposed at the end close to the drive shaft and fixedly connected with the drive shaft, the bull gear is located at the end close to the pinion and engaged with the pinion. The end part of the hand brake is connected with the drive shaft by elastic cylindrical pins instead of welding method for NSW type hand brake, which can facilitate the overhaul of the drive shaft assembly.

The enclosure is provided with a function handle, a pawl, a pawl pin and a pawl holder, the function handle is fixedly connected with the pawl pin, and the pawl is restricted on the pawl pin rotatably through a pawl holder. A counterweight is disposed on the side of pawl pin away from the pawl. The pawl is clamped between adjacent gears of ratchet, so that the ratchet can rotate clockwise driven by the drive shaft, preventing the counterclockwise rotation of the ratchet.

The hand brake further comprises a limiting device disposed on the chain winding shaft between the bull gear and the base. The part which matches with the limiting device in the base is concavity, so as to hold the limiting device. The limiting device comprises a bearing I, a spring, a spring holder, a guide plate, and a guide plate holder. The bearing I is disposed on the spring holder, and the spring is sleeved on the outside of the bearing I, the guide plate and the guide plate holder are successively disposed at one side of the spring where away from the spring holder. The guide plate holder is connected with the base fixedly. The spring is a torsion spring or a leaf spring; a stopper post III is secured to one side of the spring holder facing the spring, a stopper post $I_n$ is secured to one side of the guide plate facing the spring; a stopper post II is secured to one side of the guide plate holder facing the guide plate. The spring, used as a core part of the limiting device, makes full use of its performance Compared with a rigid limiting device, the present limiting device, on one hand, can avoid the reduction of service life under the extreme condition, and on the other hand, the self-return performance of the spring can achieve the automatic reset.

Both ends of the spring are curved; the curved shapes include arc shape, sharp corner shape or "Γ" shape, to achieve blocking the continued movement of the stopper post when the ends of the spring meet the stopper post. The spring is made of 65 Mn; the number of turns of the spring is N, $3 \leq N \leq 6$; the wire diameter of the spring is r, 4 mm≤r≤6 mm. The two curved ends of the spring pass through the same longitudinal axis, that is, the distance between the two curved ends is N full circles. The guide plate is provided with an arcuate groove that penetrates the guide plate and the stopper post II rotates in the arcuate groove. There are two types of arcuate grooves on the guide plate, the first type is traditional arcuate groove, comprising an outer circumference, inner circumference and two curved ends; and the second type does not comprise an outer circumference, comprising the inner circumference and two curved ends. The corresponding central angle of the arcuate groove is $\alpha$, $0 \leq \alpha < 360°$. The number of guide plates (9) is n, $1 \leq n \leq 10$; when $n \geq 2$, the stopper post $I_n$ on the $n^{th}$ guide plate (9) rotates in the arcuate groove of the $n-1^{th}$ guide plate; and the stopper post II rotates in the arcuate groove of the $n^{th}$ guide plate. By this way, the number of guide plates can be chosen according to the number of turns of rotations.

Preferably, the stopper post II is secured to one side of the base facing the guide plate holder. The spring adopts the torsion spring, and both ends of the torsion spring are curved hooks, and the guide plate and the guide plate holder are annular structures. The guide plate is provided with an arcuate groove that passes through the guide plate, and the width of the groove is not less than the diameter of the stopper post II, and the arc length of the groove is not more than three-quarters of the circumference. Hole matching with the stopper post II is arranged on the guide plate holder, and the stopper post II passes, by means of a hole, through the guide plate holder and rotates in the arcuate groove. One end of the torsion spring close to the torsion spring holder is clamped with the stopper post III, and another end of the torsion spring close to the guide plate is clamped with stopper post I. Clamping means that the curved hook at the end of the torsion spring is connected to the corresponding stopper post. The height of the stopper post III is $H_3$, the height of the stopper post II is $H_2$, and the height of the stopper post I is $H_1$; $r \leq H3 \leq (N-1)*r$, $r \leq H1 \leq (N-1)*r$, $H_2$ is greater than the thickness of the guide plate holder, no greater than the sum of the thickness of the guide plate and the guide plate holder. One end of the torsion spring is only clamped with the stopper post III, and the other end of the torsion spring is only clamped with the stopper post I, besides, the stopper post II is not clamped with the torsion spring.

Working principle of the present application:

(1) Braking function: pull the function handle at the "conventional" position, and rotate the hand wheel clockwise, to drive the pin wheel on the drive shaft to rotate, and transmit the torque to the pinion through a the clutch, then the pinion drives the bull gear to rotate, to achieve the braking.

(2) Quick relief function: Under braking condition, rotate the hand wheel counterclockwise about 20~60° to drive the clutch to have axial movement. The clutch disconnects the transmission between the drive shaft and the pinion, to achieve quick relief function. The angle of counterclockwise rotation is only 20~60°, so the quick relief will not cause the rotation of the hand wheel.

(3) Force adjusting function: pull the function handle at the "force adjusting" position; at this time, the pawl inside the hand brake will not work, rotate the hand wheel clockwise to drive the switch wheel on the drive shaft to rotate, and transmit the toque to the pinion through a clutch, then the pinion drives the bull gear to rotate, to achieve the braking. According to the needs, the counterclockwise rotation of the hand wheel can reduce the braking force, and the clockwise rotation of the hand wheel can increase the braking force, to achieve the force adjusting function.

Before improvement, when the hand brake is at the full relief state under the action of gravity, the chain is at the position and state as shown in FIG. 10. After improvement, by setting a limiting device at the back of the bull gear, the chain is at the position and state as shown in FIG. 11 when the hand brake is at the full relief state. Under the full relief state, the chain of the hand brake has an offset to the right by 47 mm after improvement.

Braking process: The chain is located at the position as shown in FIG. 11 at the initial relief position. At this time, one end of the torsion spring is limited to the stopper post I, and the other end is limited to the stopper post III. The guide plate connected with the stop post I is limited to the stopper post II. When baking is applied, the hand wheel rotates clockwise to drive the pin wheel to rotate by the drive shaft, and thus drive the pinion to rotate clockwise through the clutch. The pinion is engaged with the bull gear, to drive the bull gear to rotate counterclockwise. Since the stopper post III is fixedly disposed on the bull gear, the stopper post III will rotate with the bull gear, at this time, the torsion spring does not move. When the bull gear rotates one circle, the tip of the torsion spring end is blocked by the stopper post III, at this time, the torsion spring rotates counterclockwise together with the bull gear driven by the stopper post III. When the bull gear continues to rotate one circle, the tip of the other end of torsion spring is blocked by the stopper post I, at this time, the bull gear rotates two circles (chain involvement is about 500 mm) Since the stopper post I is fixedly provided on the guide plate, with the continued rotation of the bull gear, the torsion spring will drive the guide plate 4 to rotate counterclockwise by driving the stopper post I. At this time, the stopper post II fixed on the base assembly moves relatively to and the guide plate 9 move relatively, to rotate clockwise in the groove of the guide plate 9. When the stopper post II rotates at most three-quarters circle in the groove of the guide plate 9 as shown in FIG. 7, the guide plate 9 is blocked by the stopper post II. At this time, when continuing rotation, the torsion spring will produce torque to hinder the braking.

As described above, when the hand brake brakes in the present application, the limiting device can guarantee that the bull gear rotates two-and three-quarters circles (amount of involvement up to 800 mm or more) and the torsion spring will not produce reverse hindrance. The maximum involvement of the commonly used hand brake is only 458 mm, thus, the design of the limiting structure can fully meet the normal braking requirements of the hand brake.

Relief process: Under braking condition, rotate the hand wheel counterclockwise about 20~60° to drive the clutch to have axial movement. The clutch disconnects the transmission between the drive shaft and the pinion, to achieve quick relief function. The angle of counterclockwise rotation is only 20~60°, so the quick relief will not cause the rotation of the hand wheel. The chain moves under the gravity, and drive the pinion to rotate relative to the drive shaft by the bull gear, to achieve remission operation. When relief, with the rotation of the bull gear clockwise, the stopper post III will rotate with the bull gear, at this time, the torsion spring does not move. When the bull gear rotates one circle, the tip of the torsion spring end is blocked by the stopper post III, at this time, the torsion spring rotates counterclockwise together with the bull gear driven by the stopper post III. When the bull gear continues to rotate one circle, the tip of the other end of torsion spring is blocked by the stopper post I, at this time, the bull gear rotates two circles (release amount of the chain is about 500 mm) Since the stopper post I is fixedly provided on the guide plate, with the continued rotation of the bull gear, the torsion spring will drive the guide plate 9 to rotate clockwise by driving the stopper post I. At this time, the stopper post II fixed on the base assmebly moves relatively to the guide plate 9 and rotates clockwise in the groove of the guide plate 9. When the stopper post II rotates to the end of the groove in the groove of the guide plate 9, the guide plate 9 is blocked by the stopper post II, to achieve the same level of the rivet secured to the chain and chain winding shaft, avoid the dropping of chain under the action of gravity, thus there is no lateral offset between the chain center and the center of the chain winding shaft.

The application can achieve the following beneficial effects:

(1) The center distance between the drive shaft and chain which is on end of the chain winding shaft is increased by 47 mm; after installing the hand brake, the lateral offset between the chain center of chain winding shaft end and the chain center of fixed pulley is reduced to 53 mm provided that the hand brake does not interfere with the windshield of passenger vehicle, which can not only prevents the problem of the chain interfering with the fixed pulley when the hand brake is deployed and thus affecting the performance of the hand brake, but also provides for a better appearance.

(2) The end part of the hand brake is connected with the drive shaft by elastic cylindrical pins; compared with the welding method for existing hand brakes, it can facilitate the overhaul of the drive shaft assembly.

(3) The improved hand brake can guarantee the performance of the hand braking system of the truck after adjusting the position of the mounting location (to avoid interference with the windshield), and the ratio of the improved hand brake is consistent with that before improvement.

Figure 1:
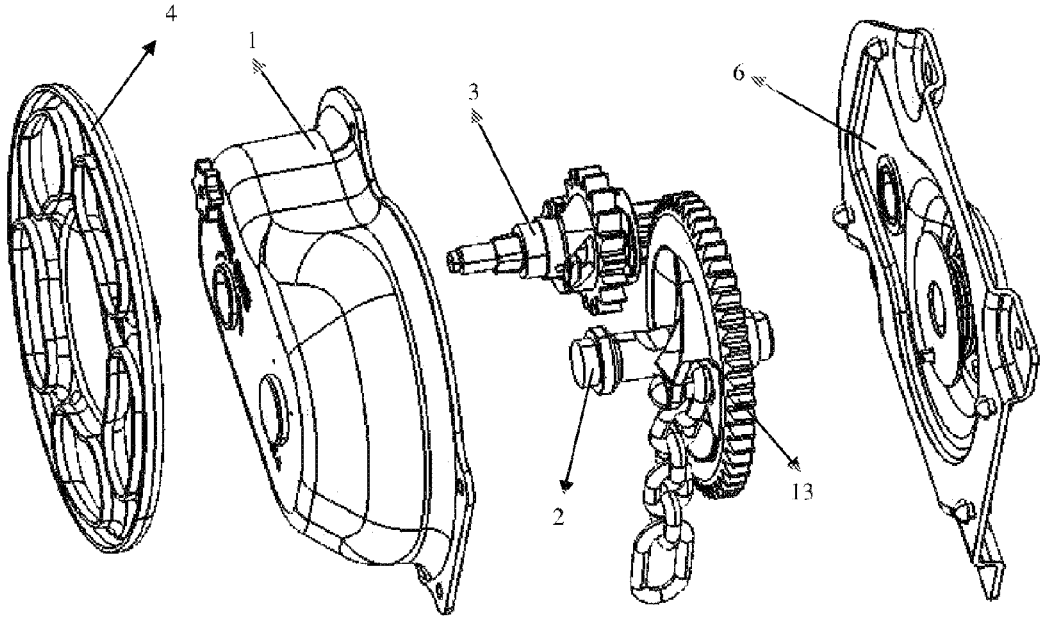
FIG. 1 is a schematic diagram I of a hand brake in embodiment 1 of the present application.
Figure 2:
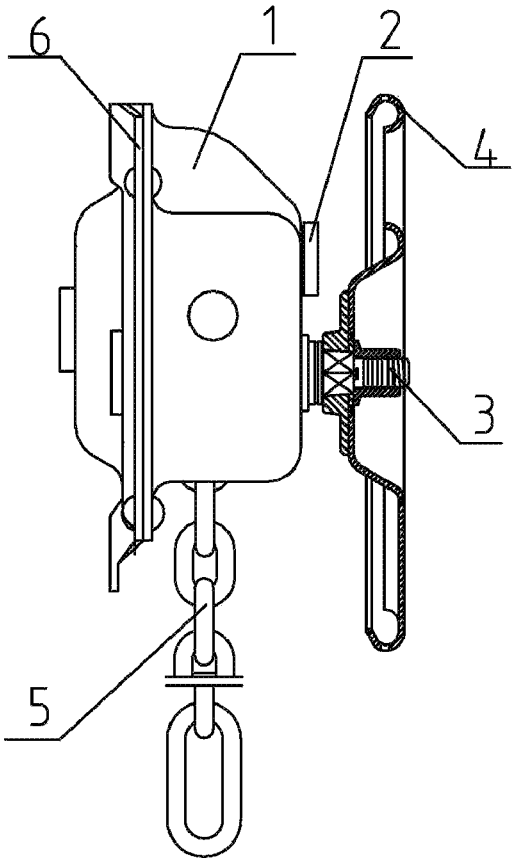
FIG. 2 is a schematic diagram II of a hand brake in embodiment 1 of the present application.
Figure 3:
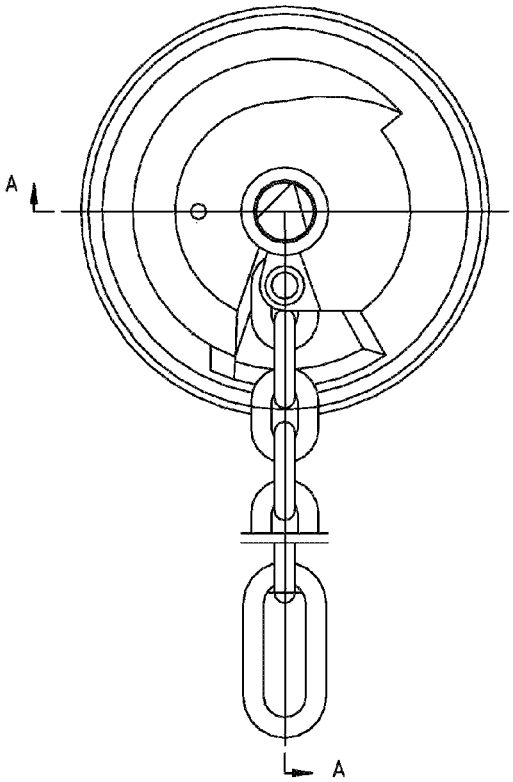
FIG. 3 is a schematic diagram I of a hand brake limiting device in embodiment 1 of the present application.
Figure 4:
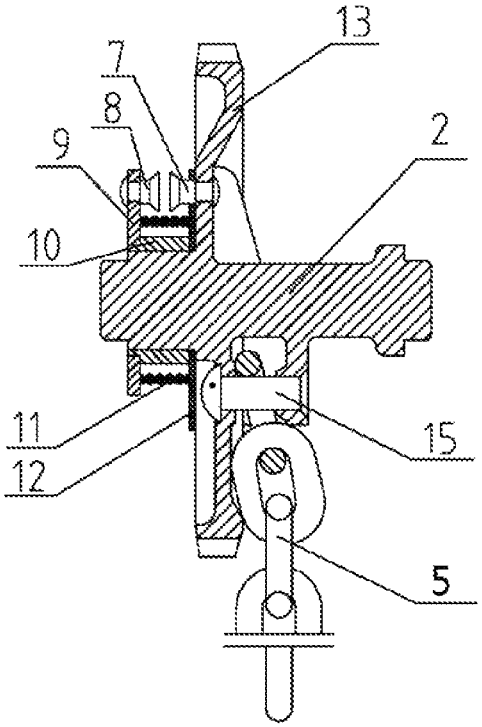
FIG. 4 is the A-A sectional view of FIG. 3.
Figure 5:
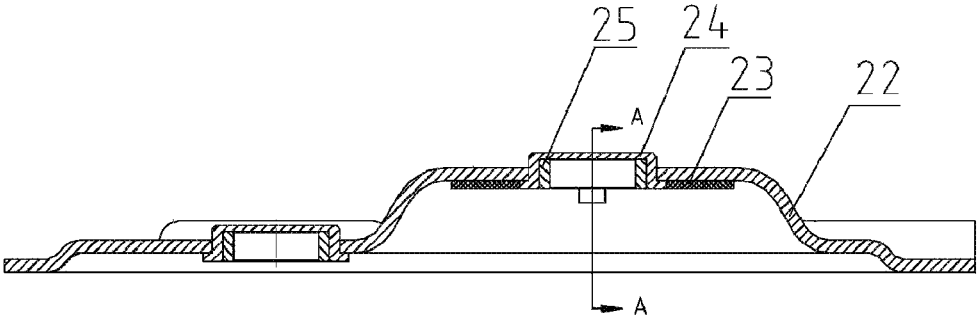
FIG. 5 is a schematic diagram I of base assembly of a hand brake in the present application.
Figure 6:
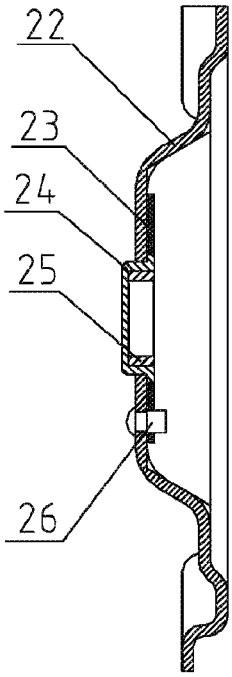
FIG. 6 is the A-A sectional view of FIG. 5.
Figure 7:
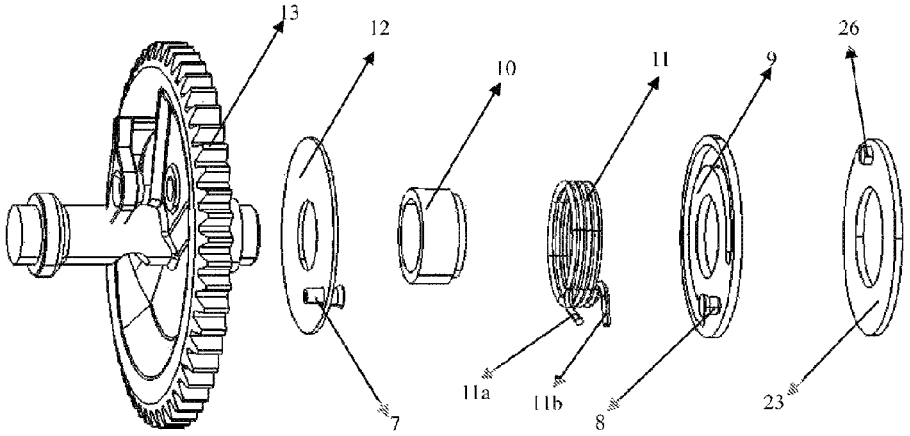
FIG. 7 is a schematic diagram II of base assembly of a hand brake in the present application.
Figure 8:
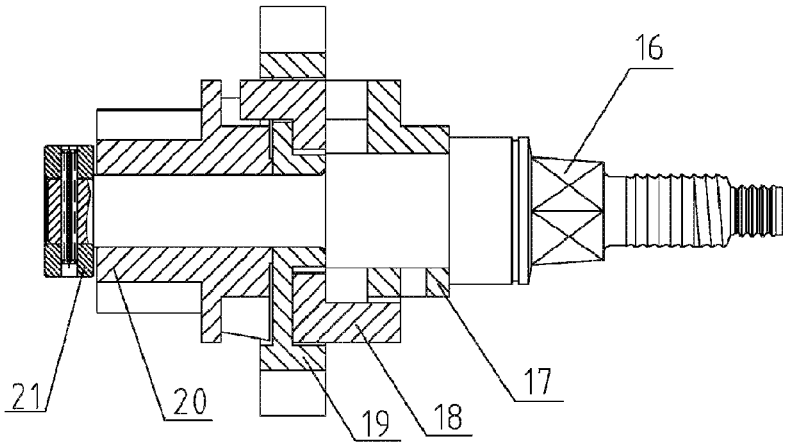
FIG. 8 is a schematic diagram I of drive shaft assembly of a hand brake in the present application.
Figure 9:
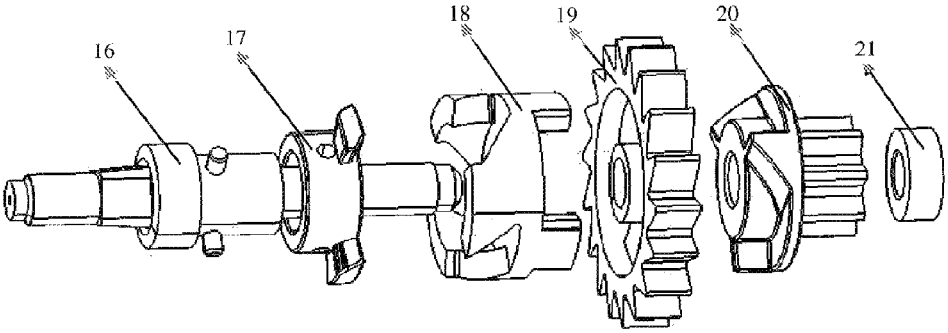
FIG. 9 is a schematic diagram II of drive shaft assembly of a hand brake in the present application.
Figure 10:
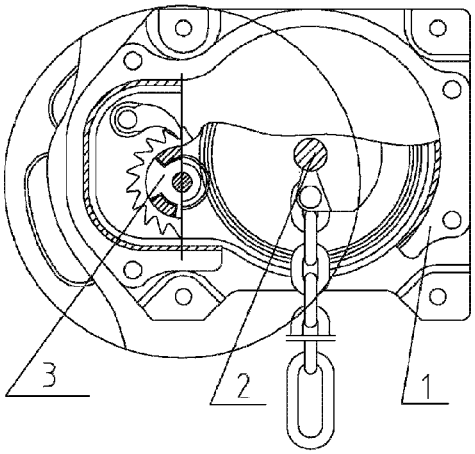
Fig. 10 (Prior Art)
FIG. 10 is a schematic diagram of chain state of the prior hand brake under the relief state.
Figure 11:
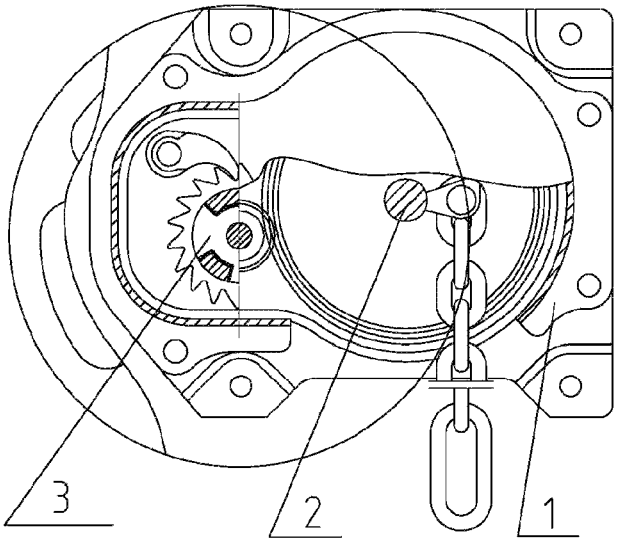
FIG. 11 is a schematic diagram of chain state of a hand brake under the relief state in embodiment 1 in the present application.
Figure 12:
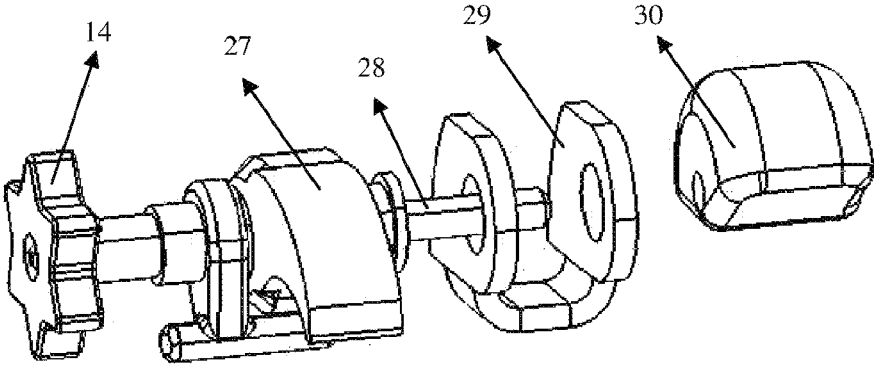
FIG. 12 is an exploded view of the handle of hand brake in the present application.
Figure 13:
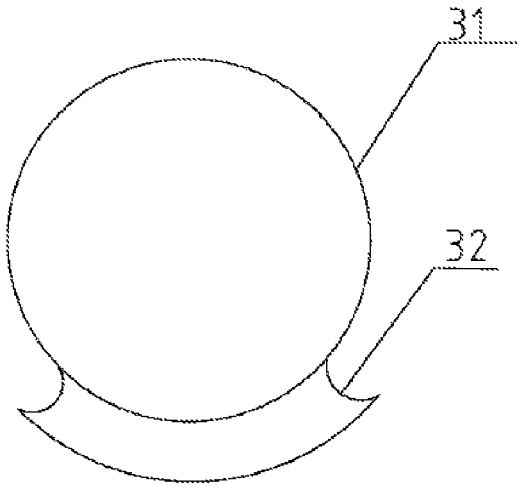
FIG. 13 is a schematic diagram of the guide plate structure in embodiment 4 in the present application.
Figure 14:
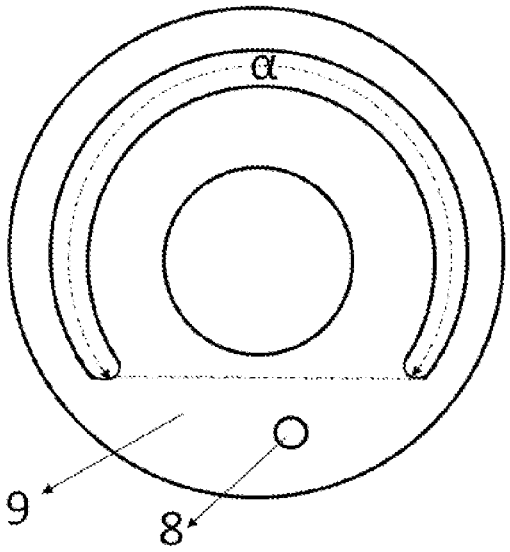

Of which, 1enclosure, 2 chain winding shaft, 3 drive shaft assembly, 4 hand wheel, 5 chain, 6 base assembly, 7 stopper post III, 8 stopper post $I_n$, 9 guide plate, 10 bearing I, 11 torsion spring, 12 spring holder, 13 bull gear, 14 handle, 15 rivet, 16 drive shaft, 17 pin wheel, 18 clutch, 19 ratchet, 20 pinion, 21 end part, 22 base, 23 guide plate holder, 24 bearing block, 25 bearing II, 26 stopper post II, 27 pawl, 28 pawl pin, 29 pawl holder, 30 counterweight, 31 inner circumference of the arcuate groove, 32 curved end of the arcuate groove.

DETAILED DESCRIPTION OF THE EMBODIMENTS

The present application is further described in combination with drawings and examples.

EXAMPLE 1

A hand brake, comprising a hand wheel 4, a chain 5, an enclosure 1, a drive shaft assembly 3 which is disposed in the enclosure 1, a bull gear 13, and a base assembly 6; the hand wheel 4 is connected to the drive shaft assembly 3, one end of the chain 5 is fixed to the bull gear 13 by means of rivets, and the main shaft of the bull gear 13 is a chain winding shaft 2. The drive shaft assembly 3 comprises a drive shaft 16, a pin wheel 17, a clutch 18, a ratchet 19, a pinion 20 and an end part 21 arranged successively; the hand wheel 4 is disposed at the end close to the drive shaft 16 and secured to the drive shaft 16, and the bull gear 13 is located at the end close to the pinion 20 and engaged with the pinion 20. The end part 21 of the hand brake is connected with the drive shaft 16 by elastic cylindrical pins, which can facilitate the overhaul of the drive shaft assembly.

The enclosure 1 is provided with a function handle 14, a pawl 27, a pawl pin 28 and a pawl holder 29, the function handle 14 is fixedly connected with the pawl pin 28, and the pawl 27 is restricted on the pawl pin 28 rotatably through a pawl holder 29. A counterweight 30 is disposed on the side of pawl pin 28 away from the pawl holder 29. The pawl 27 is clamped between adjacent gears of ratchet 19, so that the ratchet 19 can rotate clockwise driven by the drive shaft 16, preventing the counterclockwise rotation of the ratchet 19.

The hand brake further comprises a limiting device which is disposed on the chain winding shaft 2 and which is between the bull gear 13 and the base 22. The limiting device comprises a bearing I 10, a torsion spring 11, a guide plate 9 and a guide plate holder 23. The torsion spring 11 is sleeved on the outside of the bearing I 10, the spring holder 12 is disposed at one side of the torsion spring 11 close to the bull gear 13, and the guide plate 9 and the guide plate holder 23 are successively disposed on one side of the torsion spring 11 close to the base 22. A stopper post III 7 is secured to one side of the spring holder 12 facing the torsion spring 11, a stopper post I 8 is secured to one side of the guide plate 9 facing the torsion spring 11, and a stopper post II 26 is secured to the base 22 facing the guide plate holder 23. Curved hooks are provided at both ends of the torsion spring 11, and the guide plate 9 and the guide plate holder 23 are annular structures. The guide plate 9 is provided with an arcuate groove that penetrates the guide plate 9, and the width of the groove is not less than the diameter of the stopper post II 26, and the arc length of the groove is not more than three-quarters of the circumference. Holes matching with the stopper post II 26 are arranged on the guide plate holder 23, and the stopper post II 26 passes, by means of a hole, through the guide plate holder 23 and rotates in the arcuate groove. The base 22 is further provided with bearing II 25, which is disposed on the base 22 through the bearing block 24. Outside of the bearing block 24 is the guide plate holder 23. The guide plate holder is 4 mm in thickness and the guide plate is 6 mm in thickness.

The torsion spring 11 is made of 65 Mn; the number of turns of the torsion spring 11 is 4; the wire diameter of the torsion spring 11 is 5 mm. The end 11*a* of the torsion spring 11 close to the spring holder 12 is clamped with the stopper post III 7, and the end 11*b* of the torsion spring 11 close to the guide plate 9 is clamped with the stopper post I 8. The height $H_3$ of the stopper post 1117 is 5 mm, the height $H_2$ of the stopper post II 26 is 9 mm and height $H_1$ of the stopper post I 8 is 5 mm.

Since the bull gear of the hand brake after improvement adopts a limiting structure, under the natural state, there is a lateral distance of 47 mm between the center of chain and the center of chain winding shaft. The prior hand brake lacks of the limiting device, and the chain naturally drops under the action of gravity, thus there is no lateral offset between the chain center and the center of the chain winding shaft.

The improved hand brake can guarantee the performance of the hand braking system of the truck after adjusting the position of the mounting location (to avoid interference with the windshield), and the multiplying power of the improved hand brake is consistent with that before improvement. The distance between the drive shaft of the hand brake and the central line of the chain at the end of chain winding shaft is 40 mm greater than that before improvement.

TABLE 1

Comparison of technical parameters between the present application and prior hand brake

| No. | Technical Parameters | The present application | Prior hand brake |
|---|---|---|---|
| 1 | Diameter of hand wheel D/mm | 400 | 400 |
| 2 | Braking ratio γ | 27 | 27 |
| 3 | Involvement amount of chain L/mm | ≤458 | 458 |
| 4 | Input torque/N · m | 156 | 156 |
| 5 | Minimum output chain tension/kN | ≥10 | 10 |
| 6 | Machine maximum width/mm | 524 | 524 |
| 7 | Machine maximum height/mm | 400 | 400 |
| 8 | Machine maximum thickness/mm | 270 | 236 |
| 9 | Shape and size of mounting hole/mm | Lateral 286, vertical 305 | Lateral 286, vertical 305 |
| 10 | Weight/kg | 37 | 34 |

EXAMPLE 2

The difference from Example 1 is as follows: The number of turns of the torsion spring 11 is 5; the wire diameter of the torsion spring 11 is 4 mm. The height $H_3$ of the stopper post III7 is 6 mm, the height $H_2$ of the stopper post II 26 is 10 mm and the height $H_1$ of the stopper post I 8 is 14 mm.

EXAMPLE 3

The difference from Example 1 is as follows: The number of turns of the torsion spring 11 is 6; the wire diameter of the torsion spring 11 is 4 mm. The height $H_3$ of the stopper post III7 is 8 mm, the height $H_2$ of the stopper post II 26 is 8 mm and the height $H_1$ of the stopper post I 8 is 8 mm.

EXAMPLE 4

The difference from Example 1 is as follows: The limiting device comprises a bearing I 10, a leaf spring, a spring holder 12, a guide plate 9 and a guide plate holder 23, and the bearing I 10 is disposed on the spring holder 12. The leaf spring is sleeved on the outside of the bearing I 10, the guide plate 9 and the guide plate holder 23 are successively disposed on one side of the leaf spring where away from the spring holder 12. A stopper post III 7 is secured to one side of the spring holder 12 facing the leaf spring, a stopper post $I_n$ 8 is secured to one side of the guide plate 9 facing the leaf spring, and a stopper post II 26 is secured to one side of the guide plate holder 23 facing the guide plate 9; the guide plate holder is connected with the base fixedly. The two ends of the leaf spring are in "Γ" shape, and the guide plate 9 is provided with an arcuate groove that penetrates the guide plate 9; the arcuate groove comprises an inner circumference and two curved ends. The corresponding central angle of the arcuate groove α is 15°. The number of guide plates 9 is 10, the stopper post $I_n$ on the $n^{th}$ guide plate 9 rotates in the arcuate groove of the $n-1^{th}$ guide plate; and the stopper post II 26 rotates in the arcuate groove of the $10^{th}$ guide plate.

The number of turns of the leaf spring 11 is 3; the wire diameter of the leaf spring 11 is 6 mm. The height $H_3$ of the stopper post III7 is 10 mm, the height $H_2$ of the stopper post II 26 is 7 mm and height $H_1$ of the stopper post $I_n$ 8 is 6 mm.

EXAMPLE 5

The difference from Example 4 is as follows: the spring is a torsion spring, and the two ends of the spring are in sharp corner shape. The central angle α corresponding to the arcuate groove is 350°, and the number of guide plate 9 is 5. The number of turns of the torsion spring 11 is 5; and the wire diameter of the torsion spring 11 is 4 mm.

EXAMPLE 6

The difference from Example 4 is as follows: the spring is a torsion spring, and the two ends of the spring are in arc shape. The central angle α corresponding to the arcuate groove is 180°, and the number of guide plate 9 is 3. The number of turns of the torsion spring 11 is 5; and the wire diameter of the torsion spring 11 is 4 mm.

What is claimed is:

1. A hand brake limiting device, comprising a bearing I (10), a spring (11), a spring holder (12), one or more guide plate (9) and a guide plate holder (23), wherein the bearing I (10) is disposed on the spring holder (12) and the spring is sleeved on the outside of the bearing I (10), the one or more guide plate (9) and the guide plate holder (23) are disposed successively at one side of the spring away from the spring holder (12); a stopper post III (7) is secured to one side of the spring holder (12) facing the spring, a stopper post I (8) is respectively secured to one side of each of the one or more guide plate (9) facing the spring (11), a stopper post II (26) is secured to one side of the guide plate holder (23) facing the one or more guide plate (9); two ends of the spring are in curved shape, each of the one or more guide plate (9) is respectively provided with an arcuate groove that penetrates each of the one or more guide plate (9); the number of guide plates (9) is n, $1 \le n \le 10$; when $n \ge 2$, the stopper post I on the $n^{th}$ guide plate (9) rotates in the arcuate groove of the $n-1^{th}$ guide plate with the $n-1^{th}$ guide plate being adjacent to the $n^{th}$ guide plate (9) and closer to the spring; and the stopper post II (26) rotates in the arcuate groove of the $n^{th}$ guide plate.

2. The hand brake limiting device according to claim 1, wherein the spring is a torsion spring or a leaf spring; the two ends of the spring are of an arc shape, sharp corner shape or "I" shape.

3. The hand brake limiting device according to claim 1, wherein the arcuate groove on each of the one or more guide plate (9) is composed of an inner circumference and two curved ends.

4. The hand brake limiting device according to claim 3, wherein the number of turns of the spring is N, $3 \leq N \leq 6$; a wire diameter of the spring is r, 4 mm$\leq r \leq$6 mm.

5. The hand brake limiting device according to claim 3, wherein one end of the spring close to the spring holder (12) is clamped with the stopper post III (7), and another end of the spring close to the one or more guide plate (9) is clamped with the stopper post I (8).

6. The hand brake limiting device according to claim 3, wherein a height of the stopper post III (7) is $H_3$, a height of the stopper post II (26) is $H_2$, and a height of the stopper post I (8) is $H_1$; $r \leq H_3 \leq (N-1)*r$, $r \leq H_1 \leq (N-1)*r$, the $H_2$ is greater than a thickness of the guide plate holder (23), no greater than the sum of a thickness of the one or more guide plate (9) and a thickness of the guide plate holder (23).

7. The hand brake limiting device according to claim 2, wherein the arcuate groove on each of the one or more guide plate (9) is composed of an inner circumference and two curved ends.

8. The hand brake limiting device according to claim 7, wherein the number of turns of the spring is N, $3 \leq N \leq 6$; a wire diameter of the spring is r, 4 mm$\leq r \leq$6 mm.

9. The hand brake limiting device according to claim 7, wherein one end of the spring close to the spring holder (12) is clamped with the stopper post III (7), and another end of the spring close to the one or more guide plate (9) is clamped with the stopper post I (8).

10. The hand brake limiting device according to claim 7, wherein a height of the stopper post III (7) is $H_3$, a height of the stopper post II (26) is $H_2$, and a height of the stopper post I (8) is $H_1$; $r \leq H_3 \leq (N-1)*r$, $r \leq H_1 \leq (N-1)*r$, the $H_2$ is greater than a thickness of the guide plate holder (23), no greater than the sum of a thickness of the one or more guide plate (9) and a thickness of the guide plate holder (23).

* * * * *